US008032969B1

(12) United States Patent
Connelly

(10) Patent No.: US 8,032,969 B1
(45) Date of Patent: Oct. 11, 2011

(54) ATTACHABLE BRUSH FOR FOOTWEAR

(76) Inventor: Dennis E. Connelly, Centennial, CO (US)

( * ) Notice: Subject to any disclaimer, the term of this patent is extended or adjusted under 35 U.S.C. 154(b) by 563 days.

(21) Appl. No.: 12/218,136

(22) Filed: Jul. 11, 2008

(51) Int. Cl.
*A46B 15/00* (2006.01)
*A63B 57/00* (2006.01)

(52) U.S. Cl. ..... 15/160; 15/143.1; 15/210.1; 15/227; 36/136; 36/132; 36/97

(58) Field of Classification Search ..... 15/160, 15/210.1, 227; 36/97, 132, 136; *A63B 57/00*
See application file for complete search history.

(56) References Cited

U.S. PATENT DOCUMENTS 599,495 A * 2/1898 Durel et al. ..... 15/143.1
776,767 A * 12/1904 Waters ..... 36/54
1,292,288 A 1/1919 Fisher
5,485,647 A 1/1996 Durst
5,556,090 A 9/1996 Coleman
6,393,648 B1 * 5/2002 Reynolds ..... 15/160
D501,725 S 2/2005 Hay
2009/0293215 A1 * 12/2009 Zhou ..... 15/210.1

* cited by examiner

*Primary Examiner* — Monica Carter
*Assistant Examiner* — Stephanie Newton
(74) *Attorney, Agent, or Firm* — Montgomery Patent & Design; Robert C. Montgomery; Joseph T. Youksich

(57) ABSTRACT

An attachable brush for footwear, particularly suited for an umpire to clean dirt from home plate during a baseball game is herein disclosed. The footwear comprises a bristle portion along one (1) side and sized approximately one (1) inch wide and four (4) inches long, with the bristle portions being approximately one (1) inch. The brush body is attached to the footwear by means of a flap made of leather or similar resilient material. The flap is attached to the top of the brush body and is removably attached to the footwear by use of eyelets that would be interlocked with the shoelaces on the footwear. This enables the umpire to slightly lift his foot, allowing the brush to hang down, and sweep it back and forth over the home plate area. Its positioning would not allow it to interfere with walking or other activities when not being used.

18 Claims, 6 Drawing Sheets

ATTACHABLE BRUSH FOR FOOTWEAR

RELATED APPLICATIONS

The present invention was first described in a notarized Official Record of Invention on Oct. 9, 2007, that is on file at the offices of Montgomery Patent and Design, LLC, the entire disclosures of which are incorporated herein by reference.

FIELD OF THE INVENTION

The present invention relates generally to an attachable brush for footwear and, more particularly, to said attachable brush comprising a bristle portion and a brush body attached to the footwear by means of a flap that is attached to the top of the brush body and is removably attached to the footwear by use of eyelets that would be interlocked with the shoelaces on the footwear.

BACKGROUND OF THE INVENTION

In the game of baseball, it is necessary for an umpire to brush away dirt that has accumulated on home plate. This brushing action, typically done with a handheld brush, allows the batter and pitcher to clearly see where home plate is and subsequently where the strike zone is. However, this action requires the umpire to bend over, which not only takes time, but subjects the umpire to possible back stress and strain. Consequently, the umpire may not brush the plate as often as required thus compromising the strategies of the game for both teams. Accordingly, there exists a need for a means by which the brushing off of home plate can be accomplished in a manner which does not require the umpire to bend over. The development of the invention herein fulfills this need.

The present invention is footwear with an attachable brush that provides a brush along one side of one shoe that would be worn by umpires to clean the dirt from home plate during baseball games. The bristle area is envisioned to be approximately one (1) inch wide and four (4) inches long with the bristles approximately one (1) inch long themselves. The brush body is attached to the shoe by means of a flap made of leather or similar material. The flap is attached to the top of the brush and is removably attached to the shoe by use of eyelets that are interlocked with the shoelaces on the shoe. As such, the features of the invention allow the umpire to slightly lift his foot, allowing the brush to hang down, and sweep it back and forth over the home plate area. Its positioning would not allow it to interfere with walking or other activities when not being used. The use of the present invention provides umpires the ability to quickly, easily, and frequently clean home plate during baseball games without the necessity to bend over.

Several attempts have been made in the past to provide brush devices for cleaning an area. U.S. Pat. No. 5,556,090, issued in the name of Coleman, describes a kit for a baseball field that includes a brush for cleaning off home plate. However, unlike the present invention, the brush is not attached to a shoe and the Coleman brush requires a user to bend over to clean home plate.

U.S. Pat. No. 5,485,647, issued in the name of Durst, discloses a sporting event scraper brush for cleaning dirt and debris. However, the Durst device requires a user to bend over to clean an area and is not attached to a shoe.

U.S. Pat. No. 1,292,288, issued in the name of Fisher, discloses a brush for applying a liquid color or polish to a shoe. Unlike the present invention, the Fisher device does not attach to a shoe and would require a user to bend over to clean an area. Furthermore, the brush is not for cleaning an area but rather for applying polish to a shoe.

Additionally, various ornamental designs for brush devices have been provided, particularly, U.S. Pat. No. D 501,725. However, none of these designs are similar to the present invention.

The prior art appears to disclose various brush devices for cleaning an area. However, none of the prior art particularly describes an attachable brush for footwear comprising a bristle portion and a brush body attached to the footwear by means of a flap that is attached to the top of the brush body and is removably attached to the footwear by use of eyelets that would be interlocked with the shoelaces on the footwear that the instant invention possesses. Accordingly, there exists a need for a means by which the brushing off of home plate can be accomplished in a manner which does not require the umpire to bend over that operates without the disadvantages as described above.

SUMMARY OF THE INVENTION

In view of the foregoing disadvantages inherent in the prior art, it has been observed that there is need for an attachable brush for footwear comprising a bristle portion and a brush body attached to the footwear by means of a flap that is attached to the top of the brush body and is removably attached to the footwear by use of eyelets that would be interlocked with the shoelaces on the footwear that allows a user to brush off a desired cleaning area in a manner which does not require the user to bend over.

To achieve the above objectives, it is an object of the present invention to provide an attachable brush for footwear which comprises a plurality of brush bristles, a brush body attached to the plurality of brush bristles, and a flap having a plurality of eyelets attached to the brush body, wherein the flap extends vertically upwards therefrom the brush body.

A further object of the present invention is having the attachable brush further comprise a plurality of grommets located therein the plurality of eyelets whereby the grommets provide structural strength to the plurality of eyelets.

Another object of the present invention is having the flap removably attach the attachable brush thereto a piece of footwear by interlocking a lace portion of the footwear therethrough the plurality of eyelets, thereby allowing a user to sweep the brush in a sideways motion thereon a desired cleaning area.

Yet another object of the present invention is having the flap attach to the brush body by an amount of excess material which is embedded within the brush body during an injection molding or similar manufacturing process.

Still yet another object of the present invention is having the attachable brush comprise a brush width of approximately one (1) inch, a brush length of approximately four (4) inches, and a brush height of approximately one (1) inch.

Still yet another object of the present invention is having the brush body comprise a brush body width of approximately one (1) inch and a brush body length of approximately four (4) inches.

Yet still another object of the present invention is having the flap generally comply therewith an outer contour of the footwear wherein the attachable brush drapes in an arcuate manner over a side of the footwear when attached.

Still another object of the present invention is having the plurality of brush bristles made of a course bristle material.

Still yet another object of the present invention is having the plurality of brush bristles made of boar hair, horse hair, a synthetic material, or a similar material.

Yet another object of the present invention is having the brush body made of a common thermoplastic.

Still yet another object of the present invention is having the brush body fabricated through a common injection molding process.

Still yet another object of the present invention is having the flap made of leather or a similar resilient material.

Yet still another object of the present invention is having the plurality of grommets made of metal, plastic, or a similar material.

Still another object of the present invention is having the attachable brush attachable thereto either a right foot or a left foot of the footwear.

Still yet another object of the present invention is having the attachable brush used with a variety of different styles of the footwear.

Yet another object of the present invention is providing a method for using an attachable brush for footwear to clean a desired area.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
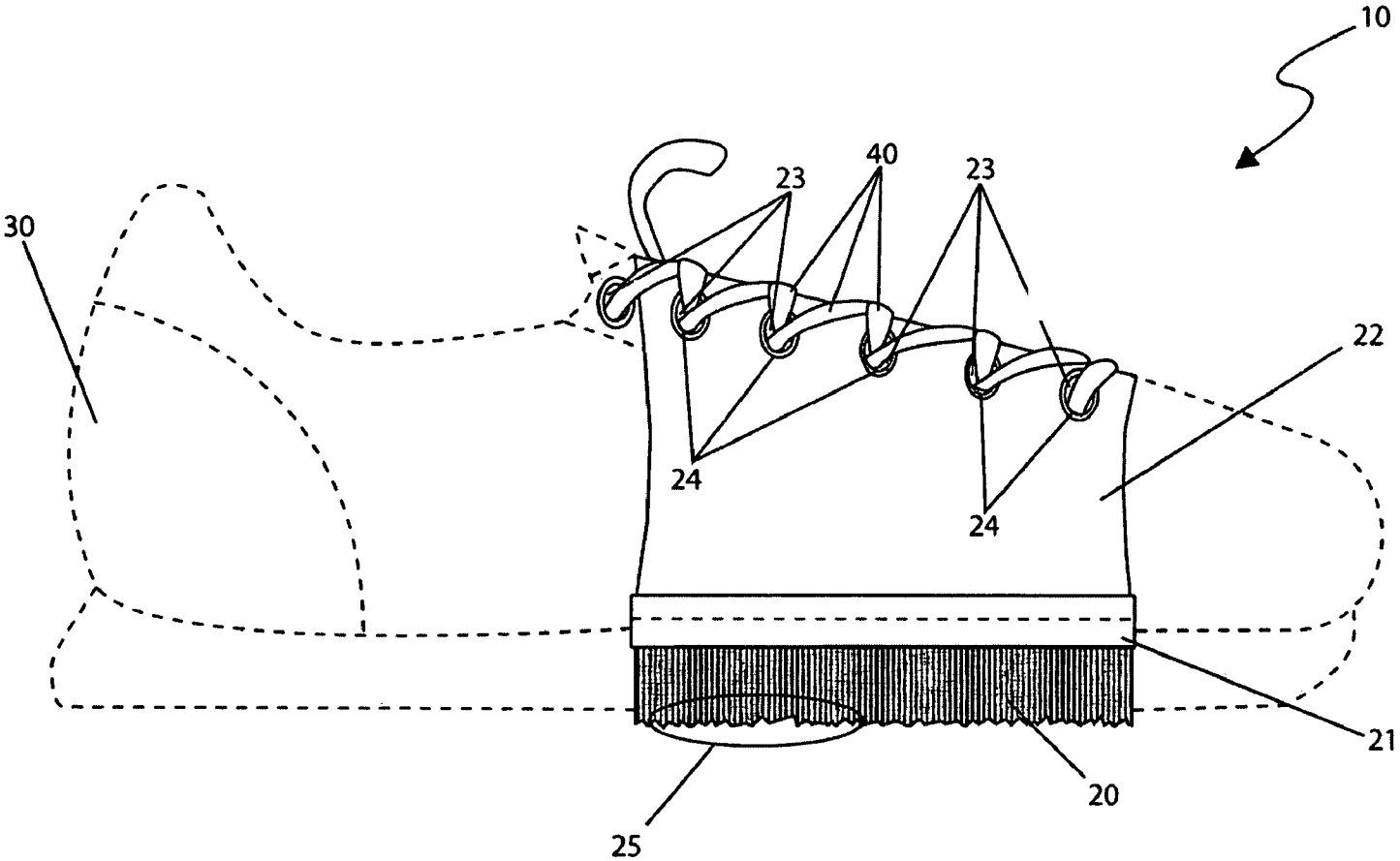
FIG. 1 is an environmental view of an attachable brush for footwear 10, according to a preferred embodiment of the present invention.

10 attachable brush for footwear
20 brush
21 brush body
22 flap
23 eyelet
24 grommet
25 plurality of brush bristles
30 footwear
40 laces

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for an attachable brush for footwear (herein described as the "device") 10, comprising an attachable brush 20 having a plurality of brush bristles 25 that would be worn on the footwear of an umpire to clean dirt from home plate during a baseball or softball game. The device 10 comprises a brush 20, a brush body 21, a plurality of brush bristles 25, and a flap 22. The device 10 is envisioned as attaching to existing ordinary footwear 30 whereby the flap 20 connects the brush body 21 to the footwear 30 using a plurality of eyelets 23 that interlock with an existing lace 40. The device 10 is supported by the side of the footwear 30 and allows an umpire to sweep the brush 20 in a sideways motion over the home plate area to clean away dirt, without bending over and while not interfering with walking or other normal activities.

Referring now to FIG. 1, an environmental view of the device 10, according to the preferred embodiment of the present invention, is disclosed. The plurality of brush bristles 25 are preferably made of a course bristle material such as boar hair, horse hair, a synthetic material, or the like. The brush 20 is envisioned to be approximately one (1) inch wide, four (4) inches long, and one (1) inch high. The apparatus 10 also comprises a brush body 21. The brush body 21 is preferably made of a common thermoplastic and fabricated through common injection molding processes. The brush body 21 is envisioned to be approximately the same length and width as the brush 20. The device 10 also comprises a flap 22. The flap 22 is preferably made of leather or a similar resilient material. The flap 20 is envisioned to generally comply therewith an outer contour of the footwear 30 allowing the device 10 to drape in an arcuate manner over a side of the footwear 30 when attached. The flap 20 attaches to the footwear 30 at the laces 40 by means of a plurality of eyelets 23 allowing a user to interlock the device 10 therewith existing laces 40 of the footwear 30. The device 10 also comprises a plurality of grommets 24 which are to reinforce the eyelets 23 within the flap 22. The grommets 24 are envisioned to be common commercially available grommets 24 made of metal, plastic, or the like.

The device 10 is envisioned to be flexible, durable, and versatile allowing use on both the left and the right foot of a user with a variety of different styles of footwear.

Referring now to FIGS. 2 through 6, various views of the device 10, according to the preferred embodiment of the present invention, are disclosed. The device 10 is illustrated showing the brush body 21 as attached to the flap 22. The flap 22 is envisioned having an amount of excess material which is embedded within the brush body 21 during an injection molding or similar manufacturing process.

It is envisioned that other styles and configurations of the present invention can be easily incorporated into the teachings of the present invention, and only one particular configuration shall be shown and described for purposes of clarity and disclosure and not by way of limitation of scope.

Figure 2:
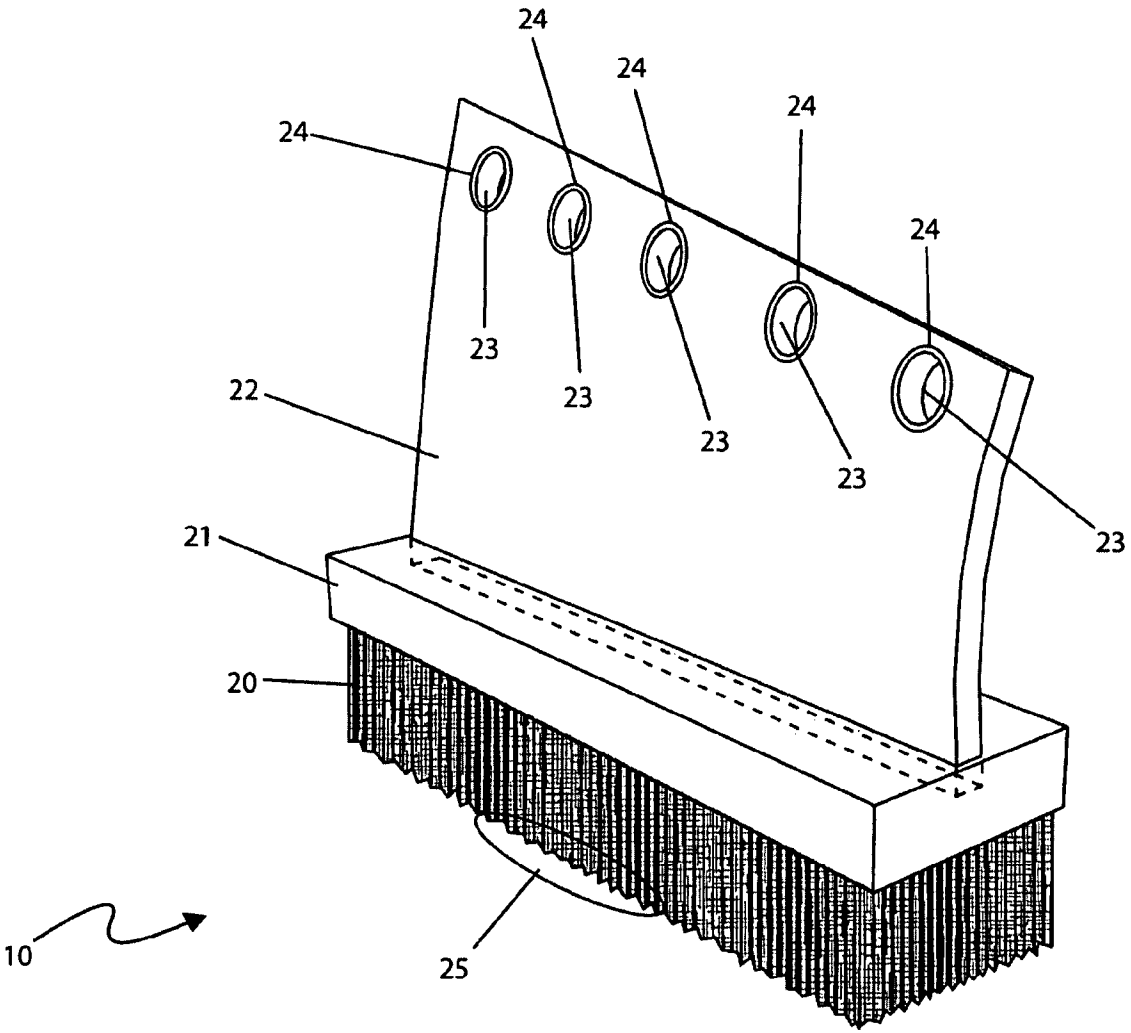
FIG. 2 is a side perspective view of an attachable brush for footwear 10, according to a preferred embodiment of the present invention.
Figure 3:
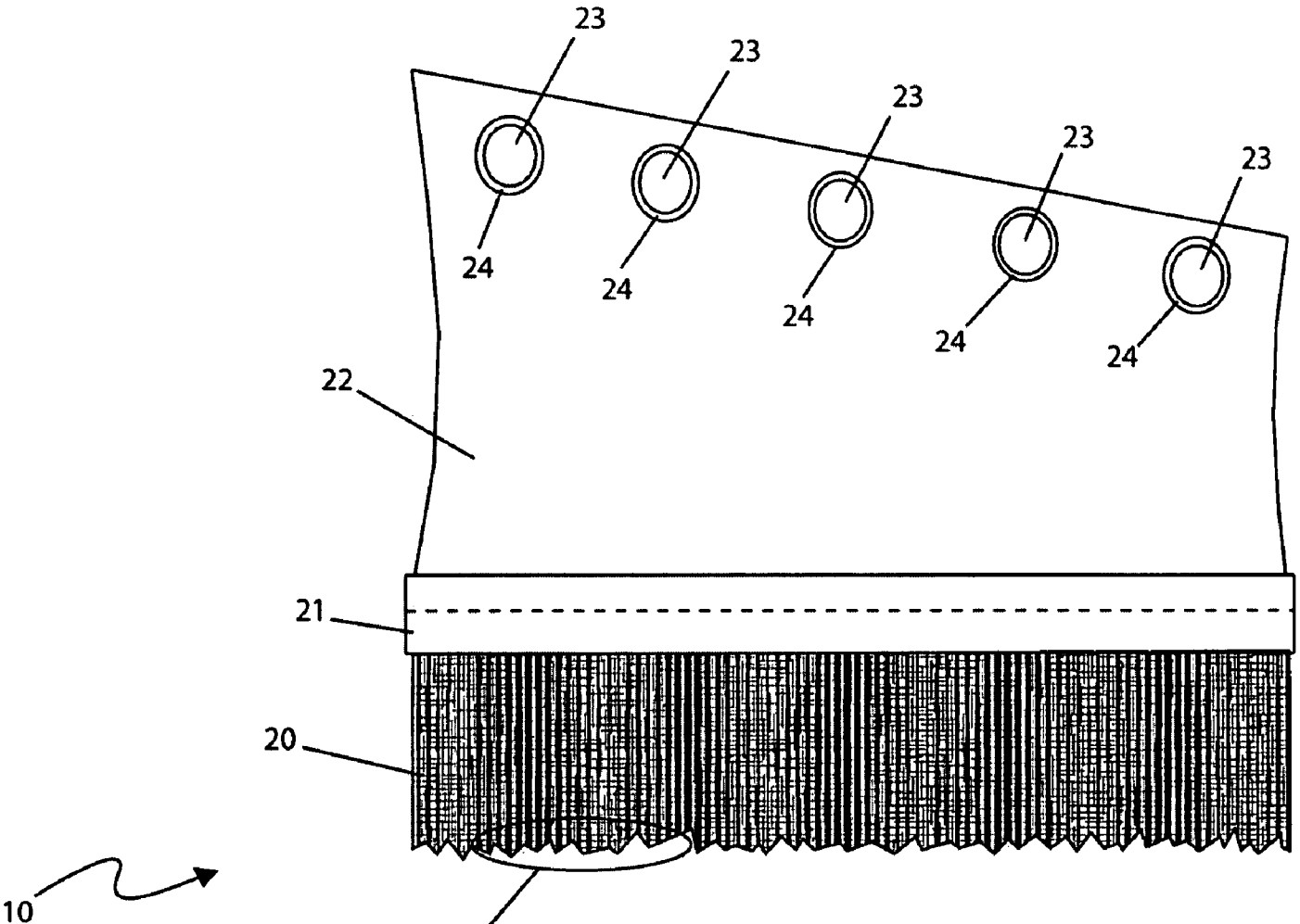
FIG. 3 is a side view of an attachable brush for footwear 10, according to a preferred embodiment of the present invention.
Figure 4:
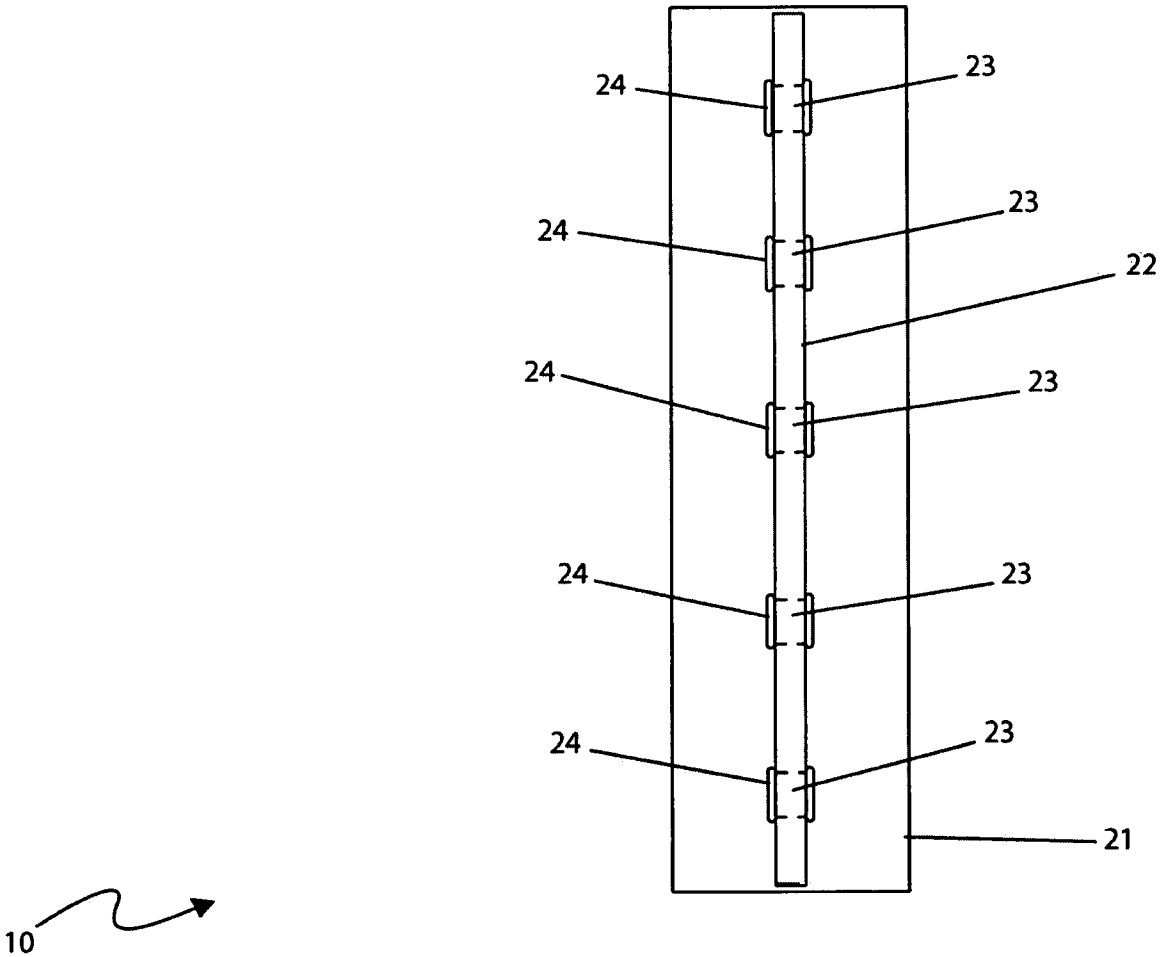
FIG. 4 is a top view of an attachable brush for footwear 10, according to a preferred embodiment of the present invention.
Figure 5:
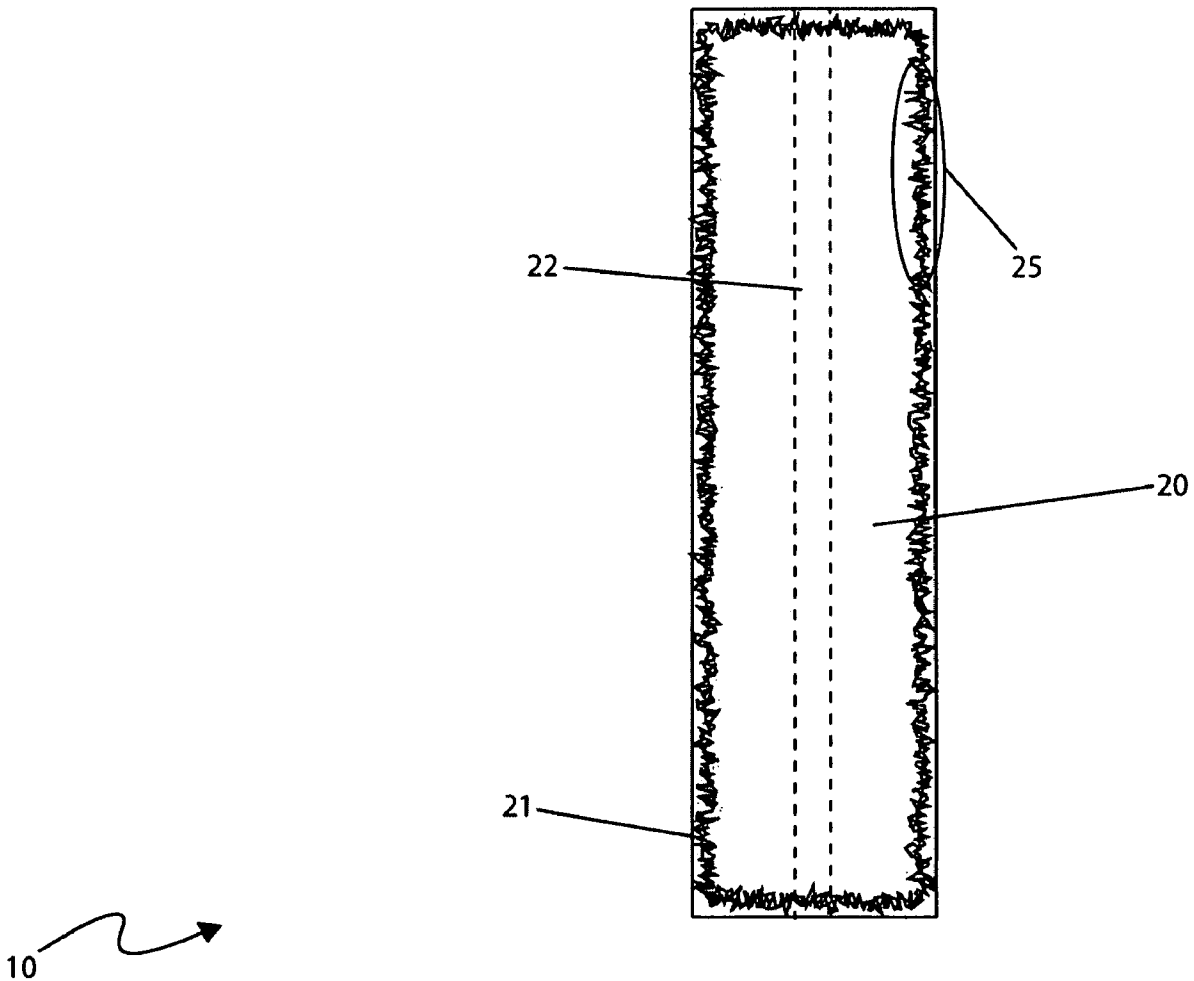
FIG. 5 is a bottom view of an attachable brush for footwear 10, according to a preferred embodiment of the present invention; and, FIG. 6 is a front view of an attachable brush for footwear 10, according to a preferred embodiment of the present invention.
Figure 6:
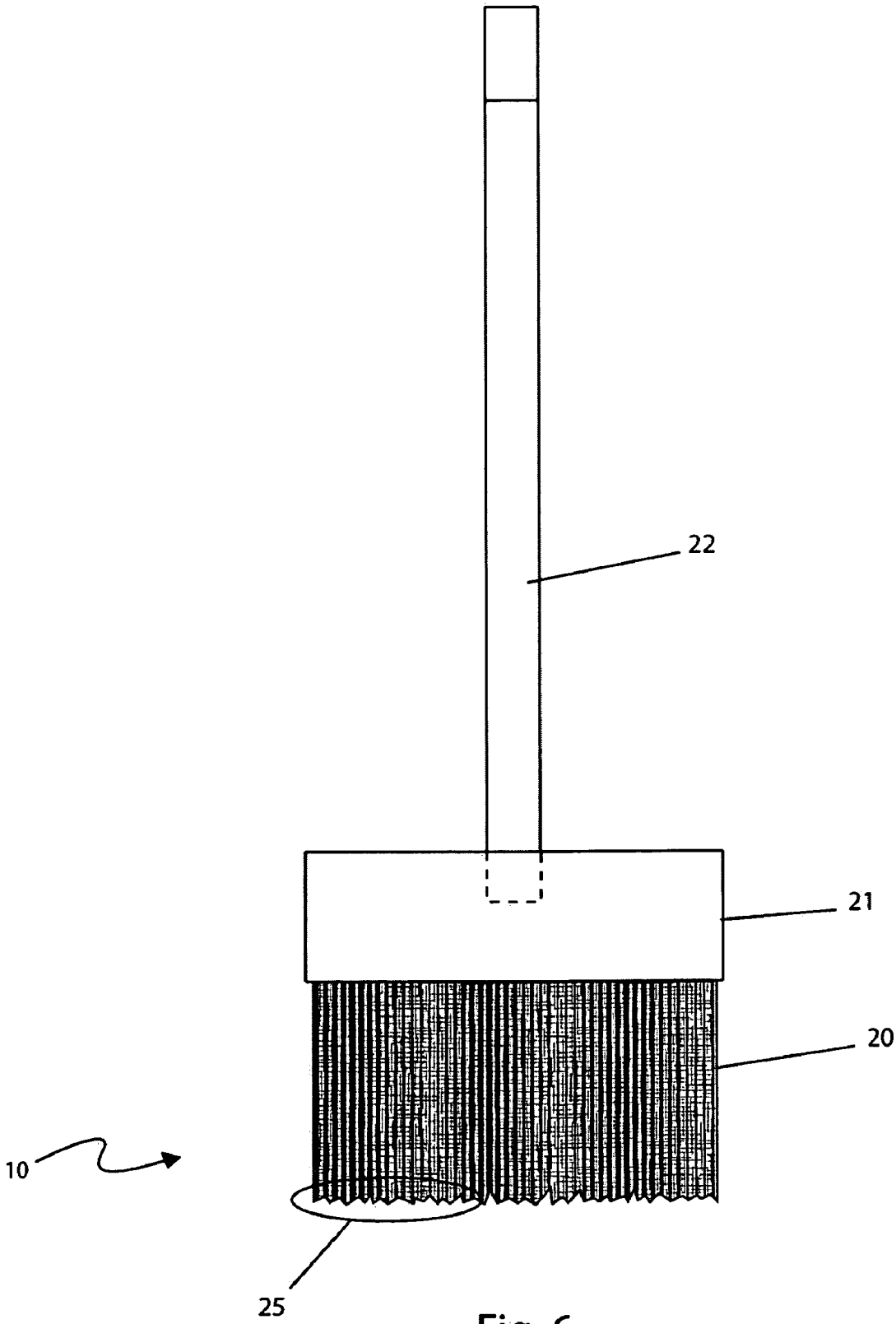

The preferred embodiment of the present invention can be utilized by the common user in a simple and effortless manner with little or no training. After initial purchase or acquisition of the device 10, it would be installed as indicated in FIGS. 1 and 2.

The method of utilizing the device 10 may be achieved by performing the following steps: choosing a left foot or a right foot to install the device 10 thereon; unlacing a portion of the laces 40 of the desired footwear 30; placing the device 10 on the footwear 30 of the desired foot with the brush 20 along a side of the footwear 30 and the eyelets 23 inline with the eyelets of the footwear 30; interlocking the device 10 with the footwear 30 by rethreading the laces 40 coincidentally though the eyelets of the footwear 30 and eyelets 23 of the surface portion of the flap 22 by the user lacing the footwear 30 as normal; standing upright and lifting the footwear 30 and the device 10 slightly off of the ground thereby letting the brush 20 hang slightly below the sole of the footwear 30; putting the brush 20 in contact with the home plate area; sweeping clean the home plate area with a sideways motion of the device 10 as the device 10 is being supported by the side of the footwear 30; and resuming a normal standing posture in which the device 10 will not interfere with standing, walking, or other normal activities.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An attachable brush for footwear, comprising:

a plurality of brush bristles; a brush body attached to said plurality of brush bristles; and, a flap comprising a plurality of eyelets attached to said brush body; and, a plurality of grommets located in said plurality of eyelets whereby said grommets provide structural strength to said plurality of eyelets; wherein said flap extends vertically upwards therefrom said brush body and removably attaches said device thereto said footwear by interlocking a lace portion of said footwear therethrough said plurality of eyelets; and, wherein said plurality of brush bristles enable a user to sweep a floor surface when said attachable brush is attached thereto said footwear.

2. The attachable brush of claim 1, wherein said flap is attached to said brush body by an amount of excess material which is embedded within said brush body during an injection molding or similar manufacturing process.

3. The attachable brush of claim 1, further comprising:

a brush width of approximately one (1) inch;

a brush length of approximately four (4) inches; and, a brush height of approximately one (1) inch.

4. The attachable brush of claim 1, wherein said brush body further comprises:

a brush body width of approximately one (1) inch; and, a brush body length of approximately four (4) inches.

5. The attachable brush of claim 1, wherein said flap generally complies therewith an outer contour of said footwear and drapes in an arcuate manner over a side of said footwear when attached.

6. The attachable brush of claim 1, wherein said plurality of brush bristles is made of a course bristle material.

7. The attachable brush of claim 1, wherein said plurality of brush bristles is made of boar hair, horse hair, a synthetic material, or a similar material.

8. The attachable brush of claim 1, wherein said brush body is made of a common thermoplastic.

9. The attachable brush of claim 1, wherein said brush body is fabricated through a common injection molding process.

10. The attachable brush of claim 1, wherein said flap is made of leather or a similar resilient material.

11. The attachable brush of claim 1, wherein said plurality of grommets are made of metal, plastic, or a similar material.

12. The attachable brush of claim 1, wherein said attachable brush can be used on either a right foot or a left foot of said footwear.

13. The attachable brush of claim 1, wherein said attachable brush can be used with a variety of different styles of said footwear.

14. An attachable brush for footwear, comprising:

a plurality of brush bristles;

a brush body attached to said plurality of brush bristles;

a flap comprising a plurality of eyelets attached to said brush body; and, a plurality of grommets located therein said plurality of eyelets whereby said grommets provide structural strength to said plurality of eyelets;

wherein said flap extends vertically upwards therefrom said brush body;

wherein said flap removably attaches said attachable brush thereto said footwear by interlocking a lace portion of said footwear therethrough said plurality of eyelets; and, wherein said plurality of brush bristles enable a user to sweep a floor surface when said attachable brush is attached thereto said footwear.

15. The attachable brush of claim 14, wherein said flap is attached to said brush body by an amount of excess material which is embedded within said brush body during an injection molding or similar manufacturing process.

16. The attachable brush of claim 15, further comprising:

a brush width of approximately one (1) inch;

a brush length of approximately four (4) inches; and, a brush height of approximately one (1) inch.

17. The attachable brush of claim 15, wherein said brush body further comprises:

a brush body width of approximately one (1) inch; and, a brush body length of approximately four (4) inches.

18. A method for using an attachable brush for footwear, said method comprising the steps of:

providing said device, comprising:

a plurality of brush bristles;

a brush body attached to said plurality of brush bristles;

a flap comprising a plurality of eyelets attached to said brush body and extending vertically upwards therefrom said brush body; and, a plurality of grommets located therein said plurality of eyelets whereby said grommets provide structural strength to said plurality of eyelets;

wherein said flap removably attaches said device thereto a piece of footwear by interlocking a lace portion of said footwear therethrough said plurality of eyelets;

choosing a left foot or a right foot of said footwear to install said attachable brush thereon;

unlacing said lace portion of said footwear;

placing said attachable brush on said footwear of said desired foot along a side of said footwear and said plurality of eyelets inline with a plurality of footwear eyelets;

interlocking said device with said footwear by rethreading said lace portion coincidentally therethough said footwear eyelets and said plurality of eyelets of said flap;

standing upright and lifting said footwear and said attachable brush slightly off of a ground surface, thereby letting said attachable brush hang slightly below a sole of said footwear;

placing said plurality of brush bristles in contact with a desired cleaning area;

sweeping clean said desired cleaning area with a sideways motion of said attachable brush as said attachable brush is being supported by said side of said footwear; and, resuming a normal standing posture in which said attachable brush will not interfere with standing, walking, or other normal activities.

* * * * *